United States Patent [19]

Reid

[11] Patent Number: 4,555,326

[45] Date of Patent: Nov. 26, 1985

[54] METHODS AND COMPOSITIONS FOR BORONIZING METALLIC SURFACES

[75] Inventor: Dwight K. Reid, Houston, Tex.

[73] Assignee: Betz Laboratories, Inc., Trevose, Pa.

[21] Appl. No.: 611,067

[22] Filed: May 17, 1984

[51] Int. Cl.[4] ..... C10G 9/12

[52] U.S. Cl. ..... 208/48 R; 201/18; 148/6.14 R

[58] Field of Search ..... 148/6.14 R; 201/18; 208/48 R

[56] References Cited

U.S. PATENT DOCUMENTS

| | | | |
|---|---|---|---|
| 1,847,095 | 3/1952 | Mittasch | 208/48 R |
| 2,063,596 | 12/1936 | Feiler | 208/48 R |
| 3,507,929 | 3/1970 | Happel | 260/679 |

FOREIGN PATENT DOCUMENTS

| | | | |
|---|---|---|---|
| 2147755 | 9/1971 | Fed. Rep. of Germany | 148/6 B |
| 275662 | 8/1928 | United Kingdom | 208/48 R |
| 296752 | 9/1928 | United Kingdom | 585/48 R |

OTHER PUBLICATIONS

Chem. Abstract, vol. 95, 1981, 95:165651v, pp. 170 and 171.

Chem. Abstract, vol. 87, 1977, 87:154474r, p. 135.

*Primary Examiner*—Sam Silverberg

*Attorney, Agent, or Firm*—Alexander D. Ricci; Bruce E. Peacock

[57] ABSTRACT

The present disclosure is directed to methods and compositions for boronizing metal and in particular ferrous surfaces. It has been discovered that if hydrocarbons are processed in metallic equipment which have been previously boronized, that coke formation and deposition which is commonly experienced at high temperatures can be minimized if not totally eliminated. The compositions utilized for this purpose are comprised of boron or boron compounds contained in an organic solvent or carrier together with specific activating materials.

12 Claims, No Drawings

METHODS AND COMPOSITIONS FOR BORONIZING METALLIC SURFACES

BACKGROUND OF THE INVENTION

The present invention is directed to methods and compositions for use in the boronizing of metallic surfaces and in particular, ferrous surfaces.

As indicated in the publication *Boronizing,* Matuschka, 1980, Heyden & Sons, Inc., Phila., Pa. and Hanser Verlag Munchen Wien, the boronization of metal surfaces provides the surface with increased resistance to crack formation, fatigue, and corrosion. According to the author "Basically boron or other elements can be diffused into the surface of a material by means of gaseous, liquid or solid substances. The processes carried out with those boron-yielding substances are based on chemical or electrochemical reactions between the boron-yielding agents and the substratum involved."

The publication sets forth a number of techniques which have been used, some successfully, others not particularly successful, to boronize a metal surface. On Page 14 of the publication is listed various remarks on boronizing agents and various techniques and agents for boronizing in the gaseous, liquid and solid processes.

The interest in providing metal surfaces with a boride coating is well documented because of the hardness and wear resistance of surfaces subjected to the process.

As indicated in the publication, "All ferrous metals, such as structural steel, case hardened steel, and tool steel, cast steel, armco iron, castings sintered iron and steels are suitable for boronizing. Other important nonferrous metals such as nickel, tungsten, molybdenum, cobalt, titanium etc., can also be boronized."

While the present invention in its broadest aspects is directed to a process and compositions utilized therein for providing a boronized metallic surface, it is more specifically directed to the application of the technology to the petroleum refining processes where fouling and coking problems are commonly encountered on the structural component of the system in contact with the heated petroleum and/or fractions thereof.

Coke deposition is generally experienced when hydrocarbon liquids and vapors contact the hot metal surfaces of the processing equipment. While perhaps not entirely technically understood, because of the complex makeup of the hydrocarbons, upon reaching elevated temperatures and coming into contact with hot metallic surfaces, the hydrocarbons undergo various changes through either chemical reactions and/or decomposition of various unstable components of the hydrocarbon. The undesired products in many instances include coke, polymerized products, deposited impurities and the like. Whatever the undesired product that may be formed, the result is the same, i.e., reduced economies of the process. If these deposits are allowed to remain unchecked, heat transfer, throughput and overall productivity are detrimentally effected. Moreover, downtime is likely to be encountered due to the necessity of either replacing and/or cleaning the affected parts of the processing system.

While the formation and type of undesired products are dependent upon the hydrocarbon being processed and the conditions of the processing, it may generally be stated that such products can be produced at temperatures as low as 100° F. but are more prone to formation as the temperature of the processing system and the hydrocarbon reach levels of 600°-1800+° F. At these temperatures, coke formation is likely to be produced regardless of the type hydrocarbon being charged. The type coke formed, i.e., amorphous, filamentous or pyrolytic, may vary somewhat; however, the probability of the formation of such is quite high.

The present inventor discovered that if metallic structures were boronized prior to contact with a hydrocarbon, retardation of coke formation in the elevated temperature processes could be achieved.

The present invention is particularly effective in hydrocarbon processing systems where temperatures reach levels of 600° to 1300° F. where amorphous and filamentous coke are likely to be formed. Amorphous coke is generally produced in systems where temperatures are less than 850° F. This type of coke generally is composed of low molecular weight polymers, has no definite structure and is sooty in nature. Above 850° F., filamentous coke is generally encountered. This type of coke, as the name indicates, takes the form of filaments that appear in some cases like hollow tubes. As opposed to amorphous coke, filamentous coke is not sooty and is hard and graphitic in nature.

Amorphous and filamentous coke formation is customarily found in hydrocarbon processing systems such as delayed coking processes (temperature 900° to 1300° F.); platforming, catalytic reforming and magnaforming processes (900° F.); residue desulfurization processes (500° to 800° F.); hydrocracking processes (660°-1,100° F.), visbreaking processes (800°-1000° F.), cracking of chlorinated hydrocarbons, and other petrochemical intermediates at similar temperatures.

Pyrolytic coke is produced in olefin manufacture where gaseous feed stocks (ethane, butane, propane, etc.) or liquid feed stocks (naphthas, kerosene, gas oil, etc.) are "cracked" by exposing such stocks to temperatures of from 1400° to 1700° F. to produce the desired olefin.

While various treatments have been proposed to eliminate or reduce filamentous coke formation at the 600° to 1300° F. temperatures, none have attained any great degree of success. In the book "Coke Formation on Metal Surfaces" by Albright and Baker, 1982, methods are described which utilize silicon and aluminum as pretreatments. In accordance with the procedure, the furnace tubes are pretreated with silicon hours before introduction of the hydrocarbon feed stocks. With the use of silicon, furnace tubes are coated by the chemical vaporization of an alkoxysilane. While U.S. Pat. Nos. 4,105,540 and 4,116,812 are generally directed to fouling problems in general, the patents disclose the use of certain phosphate and sulfur containing additives for use purportedly to reduce coke formation in addition to general foulants at high temperature processing conditions.

With respect to coke retardation in pyrolytic olefin production generally above 1400° F., various efforts have been reported, namely:

1. French Pat. No. 2,202,930 (Chem. Abstracts Vol. 83, 30687K) is directed to tubular furnace cracking of hydrocarbons where molten oxides or salts of group III, IV, VIII metals (e.g. molten lead containing a mixture of $K_3VO_4$, $SiO_2$ and NiO) are added to a pretested charge of, for example, naphtha/steam at 932° F. This treatment is stated as having reduced deposit and coke formation in the cracking section of the furnace.

2. Starshov et al, *Izv Vyssh. Uchebn. Zaved., Neft GAZ,* 1977 (Chem. Abst. Vol. 87: 15447r) describes the pyrolysis of hydrocarbons in the presence of aqueous solutions of boric acid. Carbon deposits were minimized by this process.
3. Nikonov et al., U.S.S.R. No. 834,107, 1981; (Chem. Abst. 95:135651v) describes the pyrolytic production of olefins with peroxides present in a reactor, the internal surfaces of which have been pretreated with an aqueous alcoholic solution of boric acid. Coke formation is not mentioned in this patent since the function of the boric acid is to coat the inner surface of the reactor and thus decrease the scavenging of peroxide radicals by the reactor surface.
4. Starshov et al., *Neftekhimiya* 1979 (Chem. Abst: 92:8645j) describes the effect of certain elements including boron on coke formation during the pyrolysis of hydrocarbons to produce olefins.

DESCRIPTION OF THE INVENTION

Generally, the invention entails a method of boronizing a metal surface and in particular those metallic surfaces in contact with hydrocarbon(s).

While the invention is applicable where a boronized metal surface is desired for wear resistance and hardness, the technology is particularly useful in boronizing metal surfaces which customarily experience undesirable coke formation and deposition during high temperature processing of hydrocarbons.

The method is particularly effective where the surface is composed of a ferrous metal. Iron, as well as iron alloys such as low and high carbon steel, and nickel-chromium-iron alloys are customarily used for the production of hydrocarbon processing equipment such as furnaces, transmission lines, reactors, heat exchangers, separation columns, fractionators, and the like. As earlier indicated, and depending upon the process being practiced, certain alloys within a given system are prone to coke deposition and the consequences thereof.

The present inventor discovered that coke deposition can be significantly reduced on the iron-based and/or nickel-based surfaces of hydrocarbon processing equipment if the surface or surfaces are boronized prior to placement of the equipment on stream. The invention contemplates boronizing the entire processing systems as well as only portions thereof where coke deposition problems were or have been customarily experienced.

The boron compounds which are utilizable for the present purposes include any boron compound and even elemental boron. Illustrative of the boron oxide compounds are: alkyl borates; metaborates, e.g., sodium, potassium, lithium metaborates; triethyl borate; trimethyl borate; borate salts such as sodium tetraborate, potassium tetraborate, lithium tetraborate, etc. Also utilizable are such compounds as $BO_2$, $BO_6$, metal salts containing boron oxides $Na_2B_4O_7.10H_2O$, $K_2B_4O_7.10H_2O$, $K_2B_4O_7$, $LiBO_2$, $LiBO_2 \times H_2O$, etc.

Metal borides, e.g., $TiB_2$, $ZrB_2$, $MgB_2$, $KB_6$, $SiB_6$, $SiB_4$, $SiB_3$, $W_2B+WB$, $AlB_2$, $AlB_{12}$, NiB, $LaB_6$, $ThB_4$, $B_2Se_3$; borides of materials like boron carbide, boron phosphide, boron nitride, boron halides, boron sulfide and ternary metal borides, for example MoAlB, $(Nb, Ta)_3B_2$, $Ce_2Ni_{21}B_6$; and also the use of the boron hydrides would represent a partial listing of useful materials. The preferred boride materials are the silicon borides and aluminum borides such as aluminum dodecaboride and silicon hexaboride because of their thermal stability (loss of boron above 1500° C.).

Boron halides would also be appropriate so long as any halide acids formed were controlled to assure no or minimum corrosion of the metal structural unit which they might contact.

The compositions which are utilized in accordance with the present invention are basically composed of the boron compound homogeneously dispersed in an organic solvent with preference for either a paraffinic or aromatic hydrocarbon such as light oil, heavy aromatic naphtha, kerosene and the like. Generally, any non-polar or slightly polar organic solvent should be acceptable for the purpose. It is most desirable to maintain the water content of the composition at a minimum to assure homogeneity of dispersion of the boron compound and to assure that little or no water remains on the metal surface or in the system being pretreated.

The boron compounds may be suspended in the carrier in any proportions to produce a product which provides during the treatment process as complete a boronization as possible. Of course, concentration of the boron compound can be varied depending upon the rate of boronization desired. Accordingly, product formulation lends itself to great flexibility.

Generally the product can contain on a weight basis from about 1 to 50%, with the remainder being the carrier, for example the light oil, plus the remaining essential additives. To assure maintenance of the suspension during storage and exposure to different and perhaps drastic temperature conditions or to protect the suspension during transportation, various stabilizing agents may also be added to the formulation as well as any preservative which might be desirable.

The suspension stabilization agents that have been found to be effective are generally classified as organoclay rheological and thixotropic materials. One such material in this class of components is $Al_2SO_3.SiO_2$ clay material commercially available as Bentone SD-1, Tixogel-V2 and Thixcin-R. Non-clay agents such as Carbopol or high viscosity silicone oils may also be used. The concentration by weight of the rheological agent varies depending upon the type of boron compound being used and, of course, the amount. Normally, when formulating a 40% by weight boron-based component, the amount of rheological agent may vary between 0.5 to 6% by weight of formulation although the preferred range is 2 to 4% by weight.

The use of organic materials such as high molecular weight succinimides was quite effective in keeping the boride in suspension. This type material is disclosed in U.S. Pat. Nos. 3,271,295 and 3,271,296, which are incorporated herein by reference.

For the compositions to be successful in boronizing the metal surfaces in order to inhibit coke, two criteria must be observed. Firstly, the boron compound must be homogeneously dispersed in the carrier and, secondly, there must be present in the composition an activator or combination of activators in such quantity as to activate and/or catalyze the boron of the boron compound to effectuate the boronizing of the metal surfaces. While any agents capable of activating boron are utilizable, the preferred activating agents may be somewhat different depending upon the type boron compound utilized.

The following are exemplary of the compositions which can be used to practice the technology of the invention:

1. A composition consisting of (a) any metal boride compound, (b) an activator comprising a halide member of Group IIA or Group IIIA metals plus an organic acid of pKa greater than about 2, plus optionally an ammonium halide, (c) an organic/carrier or solvent, and (d) optionally a rheological agent.

2. A composition consisting of (a) any metal boride compound, (b) an activator comprising an inorganic acid or a strong organic acid with a pKa of about 2 or less, (c) an organic carrier solvent, and (d) optionally a rheological agent.
3. A composition consisting of (a) elemental boron and/or any boron oxide compound, (b) an activator comprising a halide metal of Group IA, Group IIA, or Group IIIA, plus an organic acid of pKa greater than about 2, plus optionally an ammonium halide, (c) a non-polar organic solvent, and (d) optionally a rheological agent.

The rheological agent or agents are those as earlier described such as the Bentone SD-1. The chlorides of the metals referred to are the preferred halides while, of course, the bromides and fluorides may also be used. The metals of the groups specified would be represented by potassium (Group IA), calcium (Group IIA), and aluminum (Group IIIA). The organic acids which can be used (having a pKa of about 2 or greater) can be exemplified by glycolic acid, acetic acid, and benzoic acid. The inorganic acids utilizable include: sulfuric acid, hydrochloric acid and nitric acid.

While the above describes the use of the various agents; e.g., boron and boron compounds, activators, surfactants, suspending agents, liquid mediums, etc., as single items in a given composition, it is contemplated that mixtures of the separate items may be used so long as they are compatible.

Typical formulations would be as follows:

| | Ingredient | Percentage by Weight of Boronizing Composition Range | Preferred Range |
|---|---|---|---|
| 1. | Boron or Boron Compounds | 0.01–10 | 0.1–2.0 |
| | as borides | 1–50 | 10–40 |
| | or boron compounds as oxides | | |
| 2. | Activators | | |
| | Metal Halides (if included) | 0.01–5 | 0.2–0.5 |
| | Organic Acid | 0.1–15 | 1–10 |
| | Inorganic Acid (if included)* | 0.1–12 | 1–5 |
| | Ammonium Halide (optional) | 0.01–5 | 0.2–0.5 |
| 3. | Rheological Agent (optional) Increases as boron content increases. | 0.5–6 | 2–4 |
| 4. | Solvent/Carrier | Remainder | Remainder |

*Much of the inorganic acid that is added to the formulation is distilled off in the preparation.

The treatment dosages again are dependent upon the boronizing rate desired, and of course, the amount of boron-based compound in the formulated product. The objective is to produce most desirably from about a 90–200 micron thick boronized layer on the metallic surface. Accordingly, the temperature and time exposures of a given surface to a particular boronizing composition should be such as to provide this thickness.

The boronizing process is most effectively carried out at surface temperatures of from about 1000° to 2000° F. and preferably between 1000°–1400° F. The time of exposure can vary depending upon composition, temperature, etc. However, contact times of between 1 to 24 hours should suffice.

While it is clear that should particular metallic surfaces need to be boronized, mere contact with the appropriate composition at temperatures and for times necessary is solely required.

If it is desired to boronize an entire system, for example a hydrocarbon (petroleum) processing/refining system, it would be necessary to pump the boronizing composition into the on-line equipment to circulate such through the equipment to a holding tank and from there, back into the equipment. The equipment would be heated to about 1250° F. and the solution circulated and in contact with the metal surface(s) of the equipment for a sufficient time to produce the boronized layer of the desired thickness.

In order to establish the efficacy of the instant process the following studies were conducted utilizing the procedures and techniques described.

EXPERIMENTAL

Pretreatment Procedure

The essence of the experiment involved the use of a low-carbon steel wire (<0.45% of C) with an O.D. of 0.75 mm and a length of approximately 95 mm. The wire was mounted between two brass rods with 50 mm of the wire representing the hot portion of the metal. The wire was immersed in the *pretreatment* formulation and was electrically heated to a set resistivity. (approximately 1000° to 1400° F.) and held for a period of time depending upon the type of pretreatment formulation being used. Afterwards, the wire and the pretreatment formulation were allowed to cool to about room temperature (75°–85° F.). The wire was allowed to air dry overnight, and was weighed. The following pretreatment formulations were prepared as described. The formulations were prepared in a manner to assure the homogeneous dispersion of the boron compound. Heating the pretreatment formulation assures proper dispersion without spalling of the inert layer on the wire which, if it occurred, would leave unprotected areas. The exact boron compounds utilized are exemplified by the following formulations.

PRETREATMENT FORMULATION A

The boride (1.5 g) was added in 12 g of concentrated sulfuric acid and the mixture heated to 100° F. for 30 minutes. This mixture was carefully poured into 500 g of hexylene glycol that had been heated to 150° F. The temperature of the mixture was then brought up to 378° F. and held there for six hours. From this mixture, there was then distilled 10 ml of material (acid, water, and organic compounds). After cooling to room temperature, it was noted that a large amount of the boride was highly dispersed or had dissolved. This formulation was still acidic and weight loss of the wire was generally observed when this formulation was used for the first three times. After that, weight gains on the wire resulted. The amps used in the pretreatment procedure for this formulation were 40 and volts were 3.3.

PRETREATMENT FORMULATION B

In a glass reaction vessel, 400 g of light mineral oil, 1 g of calcium chloride, and 0.5 g of ammonium chloride were heated with stirring to 150° F. To the above was added a mixture of 1 g of metal boride in 10 g of glycolic acid, which had been heated to 150° F. for 30 minutes. The resulting mixture was heated to 410° F. with stirring for 26 hours. After cooling to room temperature, most of the materials were highly dispersed or dissolved in the oil. The amps used in the pretreatment procedure for this formulation were 42 and volts were 3.9.

PRETREATMENT FORMULATION C

In a reaction vessel, 380 g of mineral oil, 10 g of sodium chloride, 50 g of lead tetrafluoroborate, 50 g of nickel tetrafluoroborate, and 10 g of boron oxide were heated to 150° F. with stirring. The resulting mixture was heated to 410° F. for 26 hours. After cooling to room temperature, a stable dispersion did not result. Pretreatment of an iron wire for 5.5 hours with this formulation resulted in 34 mg of deposit. In another formulation, the above was repeated except no lead tetrafluoroborate was used. Pretreatment of an iron wire for 24 hours resulted in 37 mg of a boron layer.

COKING REACTION

In a glass reaction vessel equipped with a metal stirring blade, a thermocouple, a reflux condenser, and the pretreated wire mounted between two brass rods 50 mm apart, was placed 500 g of coker feed stock. The feed stock was heated to 450° F. by means of a heating mantle and then power was applied to the wire. Depending on the feed stock, the voltage to current ratio was varied. At 30 minute intervals, the current was turned back up to the initial setting until no current drop was observed. This process normally took 3 to 3.5 hours.

One hour after the power was supplied to the wire, the temperature of the reaction mixture was 650° F. (the wire was calculated to be at a temperature of 1000°–1400° F. at the start of the reaction), and stayed at about this temperature for the next 23 hours. At the end of 24 hours, the power was turned off and the reaction was cooled to 230° F., the wire removed, carefully washed with xylene, air dried overnight, and weighed.

EXAMPLE 1

The coking reaction was conducted on various coker feed stocks obtained from different refineries but the wire was not pretreated and no additives were placed in the reaction.

TABLE 1

| Coker Feed Stock | Amps | Volts | Resistivity (ohm-cm) | | mg Coke |
|---|---|---|---|---|---|
| A | 41 | 5.0 | 0.020 | | 22 |
| A | | | | | 25 |
| A | | | | | 26 |
| A | | | | | 27 |
| A | | | | | 26 |
| | | | | AVERAGE | 25 |
| B | 38 | 4.3 | 0.026 | | 538 |
| B | | | | | 366 |
| B | | | | | 434 |
| B | | | | | 442 |
| B | | | | | 377 |
| B | | | | | 563 |
| B | | | | | 559 |
| B | | | | | 451 |
| | | | | AVERAGE | 466 |
| C | 39 | 6.7 | 0.039 | | 285 |
| C | | | | | 268 |
| C | | | | | 284 |
| C | | | | | 260 |
| | | | | AVERAGE | 274 |
| D | 36 | 5.1 | 0.033 | | 154 |

EXAMPLE 2

Boronizing of the wire was accomplished as noted above under Pretreatment Procedure.

TABLE 2

| Boronization of the Iron Wire | | | | |
|---|---|---|---|---|
| Run # | Boron Compound | Pretreatment Formulation | Time of Pret. (hrs) | Weight of Boron Coating (mg) |
| 1 | SiB6 + Si | A | 3 | a |
| 2 | AlB12 | A | 2 | a |
| 3 | W2B + WB | A | 2 | a |
| 4 | W2B + WB | A | 2 | a |
| 5 | SiB6 + Si | A b | 5 | c |
| 6 | SiB6 + Si | A b | 8 | 36 |
| 7 | SiB6 + Si | A b | 24 | 91 |
| 8 | AlB12 | B | 1 | 1 |
| 9 | AlB12 | B | 1 | 1 |
| 10 | AlB12 | B | 1.2 | 1 |
| 11 | AlB12 | B | 3 | c |
| 12 | AlB12 | B | 3 | 3 |
| 13 | AlB12 | B | 4 | 5 |
| 14 | AlB12 | B | >5 | 5 |
| 15 | W2B + WB | B | 0.8 | 1 |
| 16 | W2B + WB | B | 1 | c |
| 17 | W2B + WB | B | 1.3 | c |
| 18 | W2B. + WB | B | 3 | 3 |
| 19 | W2B + WB | B | 4 | 4 |
| 20 | W2B + WB | B | 4 | 4 |
| 21 | W2B + WB | B | c | 2 |
| 22 | W2B + WB | B | c | 4 |

a = Negative weight loss occurred due to the corrosive nature of the formulation. However, a boride coating was seen on the wire.
b = 15 g of the boride was used in the formulation instead of the usual 1.5 g.
c = Not recorded.

EXAMPLE 3

This example shows the use of the treated wires in Example 2 in a coker feed stock and the inhibition of coke. The amps and volts used in these experiments were the same as used for the appropriate coker feed stock in Example 1.

TABLE 3

| Wire From Table 2, Run # | Coker Feedstock | mg Coke on Wire | % Protection |
|---|---|---|---|
| 1 | C | 9 | 97 |
| 2 | D | 10 | 93 |
| 3 | D | 52 | 66 |
| 4 | A | 8 | 68 |
| 5 | A | 20 | 20 |
| 6 | C | 105 | 62 |
| 7 | C | 102 | 63 |
| 8 | B | 2 | 99 |
| 9 | B | 46 | 90 |
| 10 | B | 8 | 98 |
| 11 | A | 7 | 72 |
| 12 | A | 17 | 32 |
| 13 | B | 309 | 34 |
| 14 | A | 29 | none |
| 15 | A | 42 | none |
| 16 | A | 39 | none |
| 17 | B | 280 | 41 |
| 18 | B | 232 | 50 |
| 19 | C | 19 | 93 |
| 20 | C | 17 | 94 |
| 21 | B | 280 | 40 |
| 22 | A | 4 | 84 |

The three runs that showed no protection, #14–16, need an explanation. All the borides examined showed protection; however, long times of wire pretreatment for aluminum and short times of wire pretreatment for tungsten show no protection. It is felt that these phenomena are due to the different particle sizes of the starting borides. The AlB2 had a 3–5 micron size while the W2B+WB had a 37 micron size. The larger size of the particles would mean longer times for boriding the surface as is seen. This would mean that there is a different optimum time for boriding depending on the boron compound and the formulation.

To establish the necessity of having the proper activators, the following tests were conducted utilizing the product produced or described and the aforementioned pretreatment procedure:

EXAMPLE 4

30 grams of $B_2O_3$ wires suspended in 300 grams of HAN (heavy aromatic naphtha). A low carbon steel wire as described earlier herein was used. No boride layer was formed by the pretreatment with the product described.

EXAMPLE 5

One (1) gram of $W_2B+WB$ suspended in 500 grams of hexylene glycol was used to pretreat a low carbon steel wire in accordance with the procedure earlier described. After 4 hours at the conditions (pretreatment procedure), no boride layer was observed.

The following formulations would be expected to provide the desired boronized layer on a steel wire surface when used in accordance with the pretreatment procedures earlier described.

EXAMPLE 6

Using the procedure for Pretreatment Formulation B, the boride would be zirconium boride ($ZrB_2$), with barium chloride and glycolic acid as the activators and Carbowax 400 as the solvent.

EXAMPLE 7

As in Pretreatment Formulation B, the components would be nickel boride ($NiB_2$), magnesium chloride and acetic acid in hexylene glycol.

EXAMPLE 8

Using the procedure for Pretreatment Formulation A, the boride could be molybdenum boride ($MoB_2$), hydrochloric acid, and hexylene glycol.

EXAMPLE 9

As in Pretreatment Formulation A, the components could be iron boride ($FeB_2$), nitric acid, and mineral oil.

EXAMPLE 10

Using the procedure for Pretreatment Formulation C, the boron oxide could be lithium borate ($LiBO_2$), with potassium chloride and glycolic acid as the activators in mineral oil.

EXAMPLE 11

As in Pretreatment Formulation C, the components could be boric acid, nickel borofluorate [$Ni(BF_4)_2$], and glycolic acid in mineral oil.

Water-Based Products

In order to determine whether or not water-based boron formulations would pretreat a metal surface, the following test was done: First, two stock solutions (500 mls)—one containing 5% boric acid in water and the other 5% boric acid with 20% ethylene glycol in water were prepared. The test involved the use of a nichrome wire. The filament had a thickness of 0.51 mm and a length of approximately 65 mm. The wire was mounted between two brass rods with 50 mm of the wire representing the hot portion of the metal. The rods and the wire were then immersed in the pretreatment solution and electrically heated to a set resistivity. The resistivity of the wire was held in the range of 0.05787–0.0625 ohm-cm during the pretreating process. The pretreating process was performed for one hour. The results show that both boric acid formulations failed to produce a layer on the metal surface. The results are summarized below.

| Pretreatment Solution | Time | Boron Deposition (mg) |
|---|---|---|
| 5% boric acid in $H_2O$ | 1 hr | None |
| 5% boric acid, 20% ethylene glycol in $H_2O$ | 1 hr | None |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. In a method of inhibiting the formation and deposition of filamentous coke on the surface of metallic equipment used for the processing of a hydrocarbon at temperatures in the range of about 900° to 1300° F., where the undesired filamentous coke formation is commonly experienced, which method comprises processing said hydrocarbon in equipment which has been previously contacted with a liquid composition comprising a boron source selected from the group consisting of elemental boron, boron oxide compounds and metal borides suspended or dissolved in an organic liquid carrier containing an activator which permits and enhances the reaction between the metal of the metal surface and the boron to achieve the boronization thereof, said contact being for a time and at a temperature sufficient to provide a uniform boronized surface on the metallic surface which will come in contact with the hydrocarbon to be processed, said surface while being contacted with said composition being at a temperature of from about 1000°–1400° F.

2. A method according to claim 1 wherein the metal surface is a ferrous metal.

3. A method according to claim 2 where the contact takes place for a time sufficient to produce a uniform boronized surface on the metal.

4. A method according to claim 3 wherein the contact time is between 1 and 24 hours.

5. A method according to claim 1 wherein the composition is selected from a composition comprising:

I. (a) a metal boride compound, (b) an activator comprising a halide member of Group IA, IIA, or Group IIIA metals or mixtures thereof and an organic acid of pKa greater than about 2, and (c) an organic/carrier or solvent, II. (a) a metal boride compound, (b) an activator comprising an inorganic acid or a strong organic acid with a pKa of about 2 or less, and (c) an organic carrier or solvent, III. (a) an elemental boron and/or boron oxide compound, (b) an activator comprising a halide of a metal of Group IA, Group IIA, or Group IIIA metals or mixtures thereof, and an organic acid of pKa greater than about 2, and (b) a non-polar organic solvent.

6. A method according to claim 5 wherein the composition contains a rheological agent to assure a homogeneous suspension of the compound in said organic carrier or solvent.

7. A method according to claim 5 wherein the boron compound is a metal boride.

8. A method according to claim 5 wherein said boron is elemental boron or a boron oxide compound.

9. A method according to claim 7 wherein said composition is silicon hexaboride, calcium chloride, glycolic acid in mineral oil.

10. A method according to claim 8 wherein said composition is boron oxide, calcium chloride, nickel tetrafluoroborate in mineral oil.

11. A method according to claim 5 wherein the composition comprises on a percentage by weight basis:

(i) from about 1.0 to about 50% elemental boron or a boron oxide compound, (ii) from about 0.01 to about 20% activator, and (iii) from about 98.99 to about 30% hydrocarbon solvent.

12. A method according to claim 5 wherein the composition comprises on a percentage by weight basis:

(i) from about 0.01 to about 10% metal boride, (ii) from about 0.01 to about 20% activator, and (iii) from about 99.98 to 70% hydrocarbon solvent.

* * * * *